United States Patent [19]

Skipor et al.

[11] 3,954,258

[45] May 4, 1976

[54] SECOND FOLD ROLLER MOUNTING AND ADJUSTMENT MEANS

[75] Inventors: Eugen Skipor, Chicago; Norman A. Brabec, Riverside, both of Ill.

[73] Assignee: Rockwell International Corporation, Pittsburgh, Pa.

[22] Filed: Mar. 24, 1975

[21] Appl. No.: 561,081

[52] U.S. Cl. ..... 270/67; 270/76

[51] Int. Cl.[2] ..... B65H 45/18

[58] Field of Search ..... 270/67, 76, 77, 80–85; 101/3–5, 22–24, 247; 241/221; 51/179; 308/28; 100/171, 168–169

[56] References Cited

UNITED STATES PATENTS

| | | | |
|---|---|---|---|
| 948,117 | 2/1910 | Tomlinson | 270/67 |
| 1,215,613 | 2/1917 | Brown | 100/169 |
| 3,691,956 | 9/1972 | James | 101/247 |

*Primary Examiner*—Edgar S. Burr
*Assistant Examiner*—A. Heinz

[57] ABSTRACT

The second fold roller mechanism of the folder includes adjustable stop members associated with the fold roller support levers for regulating and maintaining a predetermined space between the rollers in their operative position. Spring members are provided to bias the support levers against the stop members and these spring members are mounted on the stop members so that when space adjustments of the rollers are effected, the stop members, the support levers and the spring members move in unison as an integral unit and the preset tension of the spring members remains constant throughout all positions of adjustment. In the preferred embodiment, a spacer block is connected to the support lever and interposed between the stop member and the spring member. The spacer block is connected to the support lever through resilient means which, in effect, absorb the normal oscillations of the support lever, so that the spacer block remains in constant contact with the stop member and the noise level and shocks imparted to the mechanism are substantially reduced.

5 Claims, 4 Drawing Figures

SECOND FOLD ROLLER MOUNTING AND ADJUSTMENT MEANS

BACKGROUND OF THE INVENTION

In modern high speed rotary web newspaper or the like printing presses, the webs from a plurality of printing units are assembled and directed into a folder mechanism where they are associated and combined to form complete products. As each succeeding product arrives at the folding cylinder, it is severed from the ensuing web whereupon it is tucked into the nip of second fold rollers to receive a transverse or cross fold prior to being deposited upon a delivery conveyor.

The second fold rollers must be capable of consistently and positively folding and advancing the products at high speeds and in order to reduce the probability of chokes occurring, i.e. two or more products becoming jammed between the rollers, they must be accurately spaced apart with direct relation to the thickness of the products. It is preferable that the space between the rollers be slightly less than the thickness of the products and that the control springs which bias the rollers to their operative position be set to exert a precise force against the rollers which is necessary to control and advance the products through the folding nip. The roller settings are relatively critical and they must be readjusted each time there is a change in the thickness of the products to be produced.

Although the prior art is replete with second fold roller mechanisms, all of the known devices have proved to be less than satisfactory for various reasons. Perhaps the most serious and common problem resides in the fact that whenever a space adjustment of the rollers is effected, it unavoidably changes the tension of the control springs which bias the rollers to their operative position. Consequently, if the space adjustment is rather substantial it is necessary to readjust the spring tension. Since the tension of the springs at each end of the rollers must be uniform and equal and moreover, because the tension adjusting members are usually relatively inaccessible, this is a tedious, time-consuming operation.

Another disadvantage of the known fold roller mechanisms resides in their objectionable, high noise level when in operation and the premature wear of the coacting elements. This is due to the fact that as each product passes through the fold roller nip, the rollers are forced apart against the tension of their biasing springs and a gap is thus created between the roller support members and their associated stops. Although such gaps are small, in most cases not exceeding a few thousanths of an inch, nevertheless as each product passes out of the nip, the rollers snap back to their preset position and the support members ram against the respective stops. Not only does this produce a loud clatter, but the constant pounding at high speeds results in distortion and premature wear of the control elements.

SUMMARY OF THE INVENTION

The present invention is directed to improved mounting and control means for the second fold rollers whereby the disadvantages of the known mechanisms are completely eliminated. The fold rollers are mounted on pivoted support levers which have depending arms that are laterally inclined such that the depending ends thereof are disposed on the opposite side of the fold line with respect to the roller supported thereby. Coacting stop members are mounted on the frame between the depending ends of the support levers and they are adjustable whereby to effect simultaneous, equal angular adjustments of the support levers to thereby vary the space between the rollers with relation to the thickness of the products. The springs which bias the support levers against the stop members are mounted on extensions of the stop members so that when space adjustments of the rollers are made, the stop members, the support levers and the biasing springs all move in unison as an integral unit and the pre-established tension of the springs remains constant throughout the full range of adjustment.

In its preferred form, spacer blocks having resilient cushioning means therein are connected to the depending ends of the support levers and are located between the stop member and the biasing springs. The cushioning means p have predetermined compression/expansion characteristics such that they accommodate or, in effect, absorb the small angular motions of the roller support members during normal operation and the biasing springs function to maintain the spacer blocks in constant contact with the stop members. This mode of operation precludes the formation of a gap between the spacer block and the stop member so that all noise and shocks to the mechanism formerly caused by such gaps are completely eliminated.

DETAILED DESCRIPTION

Figure 2:
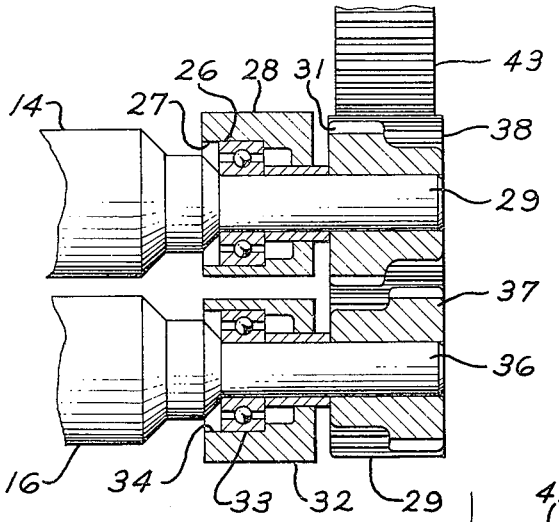
FIG. 2 is a sectional view taken substantially along line 2—2 of FIG. 1.

The invention is illustrated by way of example as incorporated in a conventional folder having a folding cylinder 10 that is suitably journalled for rotation in spaced side frames 11 and 12 and which may be provided with one or more sets of impaling pins or the like, not shown, for engaging and guiding the lead end of an assembled set of webs about the periphery thereof. Upon reaching a predetermined angular position on the folding cylinder, each succeeding product is severed from the ensuing web by a coacting cutting cylinder, not shown, whereupon a folding blade 13 carried by the folding cylinder 10 functions to tuck the product P along a predetermined fold line F and into the nip of coacting fold rollers 14 and 16 which complete the transverse fold and advance the product for deposit onto a delivery conveyor.

The function of the second fold rollers 14–16 is critical and to avoid frequent chokes at high speeds, they must be accurately spaced apart with direct relation to the thickness of the folded products and they must exert sufficient pressure thereon to positively control and advance each succeeding product through the folding nip.

In accordance with the invention, the fold rollers 14–16 are supported in an operative position relative to the folding cylinder 10 by means of respective bell crank levers 18 and 20 which, in turn, are mounted for pivoting motion about the axes of stub shafts 22 and 24, respectively, that project outwardly from the side frame 11. Although only the levers 18 and 20 on the operators side of the folder have been illustrated in the drawings, it will be understood that the opposite ends of the rollers are supported by similar levers as will be evident from FIG. 3.

The fold roller 14 is journalled for rotation in a bearing 26 located in a socket 27, see FIG. 2, provided therefor at the end of the arm 28 of the lever 18 and the shaft 29 of said roller is adapted to extend through and beyond said arm to receive a spur gear 31 which is rigidly secured to said shaft. The fold roller 16 is similarly mounted for rotation in the arm 32 of lever 20 by means of the bearing 33 seated in the socket 34 of said arm and its shaft 36 also projects through and beyond the arm to provide support for a spur gear 37 which is rigidly secured to said shaft.

As will be noted with particular reference to FIG. 2, the teeth of the spur gears 31 are offset axially relative to the teeth of the spur gear 37 to permit minimum spacing of the fold rollers 14–16 without danger of interference and these gears are adapted to mesh with their respective drive gears 38 and 39 that are mounted for free rotation about the axes of the respective stub shafts 22 and 24. The pitch circle diameters of the drive gears 38 and 39 are such that their teeth are constantly meshed so that the rollers 14 and 16 will be rotated in unison and gear 38 is adapted to be driven from a main drive gear 41 of the folder through idler gears 42 and 43.

Figure 1:
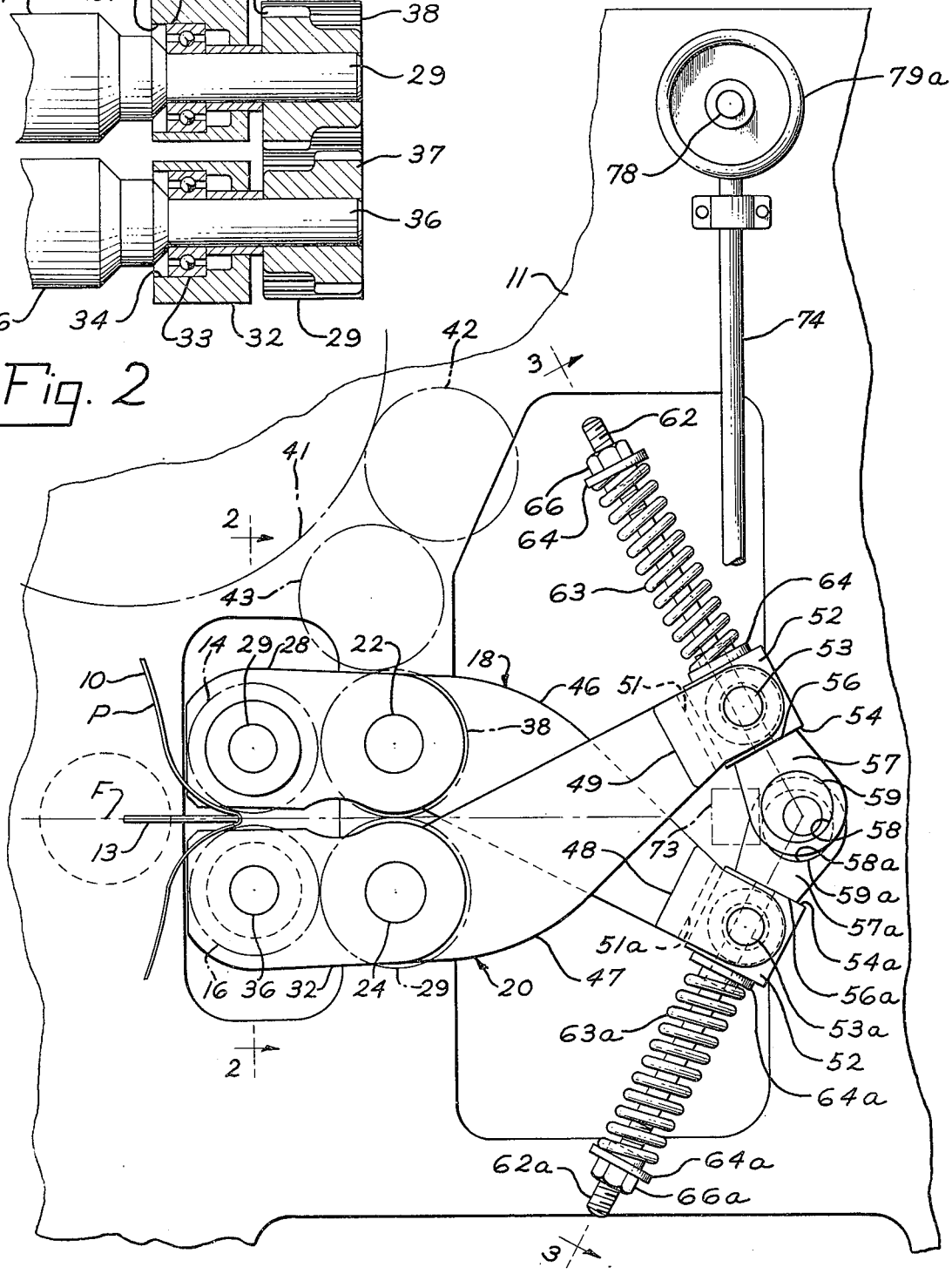
FIG. 1 is a side elevational view of a portion of a conventional folder illustrating a preferred embodiment of the invention.

The drive arrangement is such that the fold rollers 14–16 will rotate in the directions indicated by the arrows in FIG. 1 and at peripheral speeds substantially equal to or slightly faster than the peripheral speed of the folding cylinder 10 to assure that each product P will be removed from the path of the next succeeding product. Moreover, by mounting the drive gears 38–39 for rotation about the pivot axes of the levers 18 and 20, it will be seen that the angular positions of the rollers 14–16 can be varied throughout the full range of adjustment without disturbing the meshing relation of the drive gears.

At the opposite ends thereof, the bell crank levers 18 and 20 are provided with depending arms 46 and 47, respectively, which are longer than the arms 28 and 32 and which are inclined laterally in opposite directions, to the left and right, respectively, as viewed in FIG. 1, so that the respective depending ends 48 and 49 thereof are disposed on respective sides of the fold line F opposite the fold roller supported thereby.

The angular positions of the arms 46 and 47 and thus the operative positions of their associated fold rollers 14 and 16 are adapted to be controlled by control assemblies connected to the respective depending ends 48 and 49 and which will now be described. However, because the respective control assemblies are identical, the assembly associated with the arm 47 for roller 16 will be described in detail and the same reference numbers, with the addition of the suffix (*a*), will be used to denote the corresponding elements of the control assembly for the arm 46 of roller 14.

Figure 3:
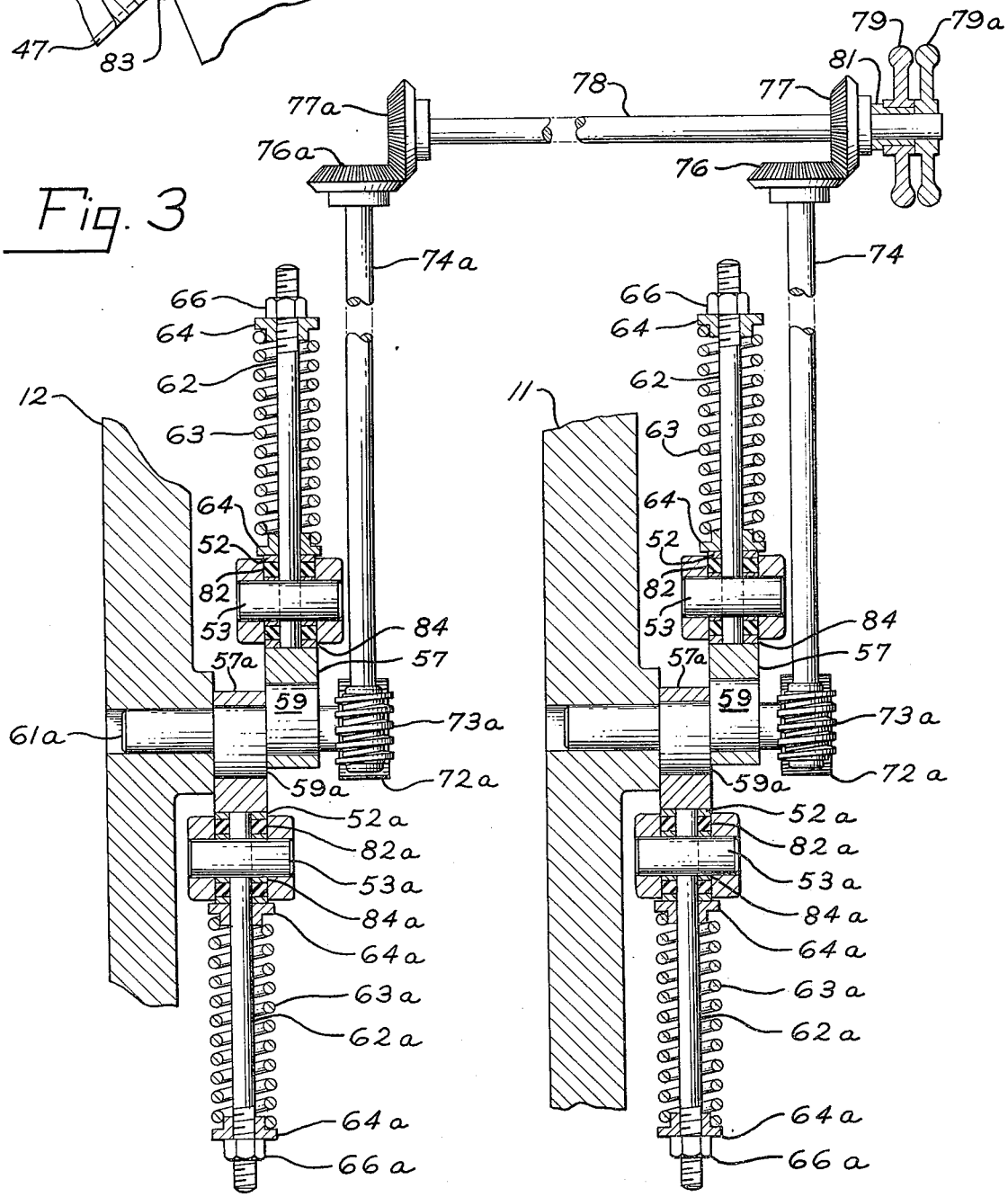
FIG. 3 is a sectional view taken along line 3—3 of FIG. 1 and illustrating the control means at both ends of the fold rollers.

With particular reference now to FIGS. 1 and 3, it will be seen that the end 49 of arm 47 is bifurcated to provide a slot 51 in which a spacer block 52 is mounted for pivoting motion about the axis of a pivot pin 53.

The spacer block is somewhat wider than the end 49 of arm 47 so that it projects beyond the edges of said arm, and the side face 54 thereof is adapted to coact with the stop surface 56 of an adjustable stop member 57 to thereby maintain the arm 47 and thus the roller 16 in a predetermined position. The stop member 57 is in the form of a metal strap or collar having a transverse opening 58 formed therein and which is adapted to fit snugly, but freely rotatably over an eccentric camming portion 59 on a control shaft 61 that projects from the side frame 11 and is adapted to be rotated about an axis coincident with the plane of the fold line F. The stop member 57 is also provided with a rod 62 that extends through openings provided therefor in the spacer block 52 and pivot pin 53 and it carries at its free end a compression spring 63 which resiliently biases the spacer block 52 against the stop member 57. The spring 63 is confined between washers 64 and is retained in position on the rod 62 by a nut 66 which is also adjustable whereby to vary the spring tension.

As stated above, the elements of the control assembly for the arm 46 are identical with those for the arm 47 and the stop member 57*a* is snugly, but rotatably mounted over a second eccentric camming portion 59*a* on the control shaft 61. The camming portions 59 and 59*a* are so oriented that, upon rotation of the control shaft 61 in either direction, the stop members 57–57*a* and therewith the arms 46 and 47 will be displaced, scissors fashion, to precisely equal extents in oppposite directions to vary the space between the fold rollers 14–16 and thus the peripheral surfaces of said rollers will always be equidistant from the fold line F in all adjusted positions.

For effecting rotation of the control shaft 61, the latter is provided with a worm gear 72, see FIG. 3, on its projecting end which is adapted to be actuated by a worm 73 on the end of a drive shaft 74. A bevel gear 76 at the other end of said drive shaft meshes with a companion bevel gear 77 which is freely rotatable on a control shaft 78 and which has a manual control wheel 79 secured to the hub 81 thereof. The control shaft 61a, see FIG. 3, for the control assemblies at the opposite ends of the fold rollers 14–16 is similarly actuated through a worm gear 72*a* on the projecting end thereof and which is adapted to be rotated by a worm 73*a* on a shaft 74*a*. A bevel gear 76*a* on the shaft 74*a* meshes with a bevel gear 77*a* on the control shaft 78 which latter extends transversely across the width of the folder and is adapted to be manually actuated by means of a handwheel 79*a* secured to the free end thereof. It will thus be seen that by rotating both of the handwheeels 79–79*a* in unison, corresponding space adjustments will be effected at both ends of the fold rollers. However, by rotating only one handwheel or by turning both handwheels in opposite directions, the space between the fold rollers can be varied from end to end to accommodate products of non-uniform thickness as is well known in the art.

From the description thus far, it will be apparent that by rotating the control shafts 61–61*a* by means of the handwheels 79–79*a*, the camming portions 59–59*a* will be rotated to displace the stop members 57–57*a* in unison and to equal extents in opposite directions to thereby vary the space between the coacting fold rollers 14–16. Because the spacer blocks 52–52*a* and biasing springs 63–63*a* are mounted for movement as integral units with the respective stop members 57–57*a* the preestablished tension of the springs will remain constant throughout the full range of adjustment. By the same token, the tension of the springs can be adjusted when and if necessary without in any way disturbing the operating positions of the fold rollers. Moreover, because the force of the springs 63–63*a* is exerted between the nuts 66–66*a* and the stop members 57–57*a* and not against the camming portions 59–59*a*, it will be evident that very little effort is required to effect adjustments and therefore wear of the coacting elements is substantially minimized.

As thus far described, it will be apparent that as each product P is tucked between the fold rollers 14–16, the latter will be displaced a small distance laterally and because of their greater length, the depending ends 48 and 49 of the arms 46 and 48 respectively, will be moved a proportionately greater distance away from the fold line F against the tension of the springs 63–63*a*. Ordinarily, this would create a gap between the side face 54–54*a* of the spacer block 52–52*a* and the stop surface 56–56*a* of the stop member 57–57*a* leading to objectionable noise and shocks to the respective elements as they snap back into contact.

To avoid these objectionable conditions, the present invention incorporates cushioning means to, in effect, absorb the normal small oscillating motions of the arms 46 and 47 whereby the spacer block 52 is permitted to remain in contact with its associated stop member 57 during normal operation.

Figure 4:
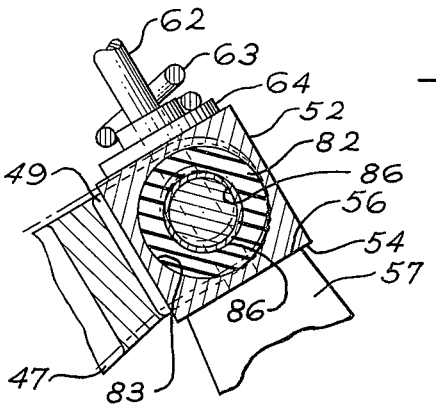
FIG. 4 is an enlarged, fragmentary sectional view illustrating the compression/expansion function of the cushion means in the spacer blocks.

With more particular reference to FIGS. 3 and 4, it will be seen that the cushioning means comprises a resilient annular member 82 which may be formed from rubber, polyurethane or the like material and which is adapted to fit within a transverse, circular opening 83 formed in the spacer block 52. A coaxial hole 84 is provided in the cushion member to receive a bushing 86 which latter is mounted over the pivot pin 53. The cushion member has the necessary compression/expansion characteristics such that it will permit the arm 47 to oscillate through its normal increment as products P pass through the nip of and displace the rollers 14–16 and it is adapted to provide the reactive force necessary against the arm 47 to maintain the roller 16 in contact with the product with the required pressure.

It will be appreciated that the spring 63 will be adjusted to exert a substantially greater force on the spacer block 52 than that required to maintain the roller 16 in pressure contact with the products P so that the end face 54 of the spacer block 52 will be maintained in constant contact with the stop surface 56 of the stop member 57 and all of the motion of the arm 47 will be absorbed or accommodated by corresponding compression/expansion of the cushion member 82.

The function of the cushion member 82 is illustrated to a somewhat exaggerated extent in FIG. 4 wherein it will be seen that, in a static condition of the fold roller assembly, i.e. when no product P is between the fold rollers 14–16, the cushion member will maintain the pivot pin 53 and thus the end 49 of arm 47 in a central position intermediate the side edges of the spacer block 52 as indicated by the solid lines in the drawing and the force of the spring 63 will maintain the spacer block 52 in intimate contact with the stop member 57. When a product P enters the nip of the fold rollers 14–16, they will be displaced laterally and the arm 46 will be pivoted proportionately, to the right as viewed in FIG. 4 thereby compressing one side of the cushion member 82 between the pivot pin 53 and the wall of the opening 83 in the spacer block 52 whereas the opposite side of the cushion member will expand to compensate for the lateral movement of the pin 53. The cushion member 82 is preferably compressed or preloaded upon being mounted in the spacer block and thus will exert a reactive force upon the arm 47 of sufficient magnitude when compressed to maintain the fold roller 16 in contact with the product P under a predetermined pressure. Obviously, the spring 63 will be tensioned so as to exert a substantially greater pressure upon the spacer block 52 so that the latter will remain in intimate contact with the stop member 57.

It will thus be evident that during normal operation of the folder, the sole function of the spring 63 is to maintain the spacer block 52 in intimate contact with the stop member 57 and that the cushion member 82 not only absorbs the motion of the lever 20, but also provides the reactive force to maintain the roll 16 in proper pressure contact with the products P. Under these circumstances, it will be apparent that the spring 63 could be eliminated and the spacer block 52 could be rigidly secured to the stop member 57 by means such as the nut 66. However, it is virtually essential to employ the spring 63 as a safety factor to absorb the increased motion of the arm 47 in the event of a choke and thereby avoid serious damage to the mechanism.

While we have herein disclosed a preferred embodiment of the cushioning member as comprised of an annular ring of rubber or the like material, it will be readily apparent that other comparable means can be employed. For example, by modifying the shape of the opening 83 in the spacer block, it would be a simple matter to substitute either leaf, coil or Belleville springs having the appropriate spring rate to accomplish essentially the same results and it is intended that such alternative means will come within the spirit and scope of this invention.

We claim:

1. In a printing press folder mechanism having a folding cylinder, a folding blade, and a pair of parallel fold rollers defining a fold plane for receiving products tucked therebetween by said folding blade and for advancing said products along a predetermined fold line, the improvement comprising two mounting units supporting opposite ends of the fold rollers, each unit inturn including a pair of levers mounted for pivoting motion about spaced, parallel axes and having first arms for supporting said fold rollers on opposite sides of and for movement toward and away from said fold plane, second, laterally inclined arms on said levers having free ends thereof disposed on the side of said fold plane opposite with respect to the fold roller supported thereby, a stop member for each one of said pair of levers, said stop members being located between the free ends of said second arms and having coaction therewith to limit the movement of said fold rollers toward said fold plane, resilient spring means mounted on said stop members and adapted to bias the free ends of said second arms toward the respective stop members under a predetermined pressure, and control means for adjusting the respective stop members, levers and resilient spring means as integral units in unison and in opposite directions to thereby vary the positions of said fold rollers relative to said fold plane.

2. A folder mechanism as set forth in claim 1 wherein said control means includes a shaft mounted for rotation about an axis coincident with said fold plane and having two eccentric camming portions thereon, said stop members being mounted on the respective camming portions.

3. A folder mechanism as set forth in claim 1 further including a spacer block located between the stop member and said resilient spring means, and means mounting the spacer block on the free end of said second arm including a second resilient means, said second resilient means permitting limited movement of said second arm relative to said spacer block as products pass between said fold rollers while said resilient spring means maintain the spacer block in intimate contact with the stop member.

4. A folder mechanism as set forth in claim 3 wherein said second resilient means comprises an annular member mounted within said spacer block and pivotally mounted on said second arm.

5. A folder mechanism as set forth in claim 1 further including gear means or positively driving the fold rollers in opposite directions and including coacting drive gears mounted for rotation about the pivot axes of said levers.

* * * * *